US006447665B1

(12) United States Patent
Johnson et al.

(10) Patent No.: US 6,447,665 B1
(45) Date of Patent: Sep. 10, 2002

(54) FASTER TWO-STEP SEALING OF ANODIZED ALUMINUM SURFACES

(75) Inventors: Philip M. Johnson, Southfield; Lawrence R. Carlson, Waterford; Scott A Wojciechowski, Beverly Hills, all of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/486,163

(22) PCT Filed: Aug. 19, 1998

(86) PCT No.: PCT/US98/16460

§ 371 (c)(1),
(2), (4) Date: May 17, 2000

(87) PCT Pub. No.: WO99/10567

PCT Pub. Date: Mar. 4, 1999

Related U.S. Application Data

(60) Provisional application No. 60/056,679, filed on Aug. 22, 1997, and provisional application No. 60/058,317, filed on Sep. 9, 1997.

(51) Int. Cl.[7] ..... C25D 11/18; C23C 22/82; C23C 28/00

(52) U.S. Cl. ..... 205/203; 205/204; 148/272; 148/276

(58) Field of Search ..... 148/272, 276; 205/202, 203, 204, 229

(56) References Cited

U.S. PATENT DOCUMENTS

| | | | | |
|---|---|---|---|---|
| 4,121,980 A | * | 10/1978 | Gohausen et al. | 204/35 N |
| 4,225,398 A | * | 9/1980 | Hasegawa et al. | 204/33 |
| 4,939,001 A | * | 7/1990 | Brodalla et al. | 427/419.2 |
| 5,225,068 A | * | 7/1993 | Bartkowski et al. | 205/204 |
| 5,374,347 A | * | 12/1994 | Pearlstein et al. | 205/203 |
| 5,411,607 A | * | 5/1995 | Basaly et al. | 148/272 |
| 5,478,415 A | | 12/1995 | Massad et al. | 148/272 |

* cited by examiner

*Primary Examiner*—Edna Wong
(74) *Attorney, Agent, or Firm*—Stephen D. Harper; Daniel S. Ortiz

(57) ABSTRACT

Anodized aluminum surfaces are advantageously sealed by an energy- and time-saving two step process, in which the first step is contact at not more than 75° C. with a solution containing lithium and fluoride ions and, optionally, surfactant. The second necessary step is treatment with hot water or steam, which may be completed in considerably less time when only hot water or steam is used for sealing. Conventional smut inhibitors and/or neutral buffers as used in hot water for single step sealing may advantageously be included in the second step of this process. 100–1000 ppm concentrations of nickel and/or cobalt ions in the treatment liquid for the second treatment step, if environmentally tolerable, make it possible to complete this step in as little as 10 minutes at a temperature as low as 88° C.

18 Claims, No Drawings

FASTER TWO-STEP SEALING OF ANODIZED ALUMINUM SURFACES

This application claims the benefit of provisional application Ser. No. 60/056,679 filed Aug. 22, 1997 and provisional application Serial No. 60/058,317 filed Sep. 9, 1997.

BACKGROUND OF THE INVENTION

This invention relates to compositions and processes for sealing oxide layers formed by anodization on surfaces of aluminum and its alloys containing at least 75 atomic percent of aluminum; both the pure metal and alloys are designated hereinafter simply as "aluminum", unless the context requires otherwise. The anodization that precedes use of a process according to this invention is itself conventional and not in general the subject of this invention, although as noted below the invention is particularly advantageously applicable to surfaces formed by anodization under particular conditions.

It is generally known in the anodization art that for most practical uses the coatings initially formed on aluminum by anodization need to be "sealed" before use in order to have a long service life, presumably because the initially formed coatings have micropores that extend from the outer surface nearly to the original metal surface. Steam and hot water have commonly been used for sealing since early in the development of the art and generally are still technically satisfactory but slow. Various additives that improve properties in specific sealing circumstances, conserve energy by giving satisfactory sealing at lower temperatures, reduce pollution by replacing previously used materials with high pollution potential with other materials less damaging to the environment, and/or reduce the time required for sealing are known in the prior art, but further improvements along these lines, particularly reductions in total process time and/or in use of pollutants, are still desirable and are the general objects of this invention. Other more specific objects of the invention will be apparent from the description below.

Except in the claims and the operating examples, or where otherwise expressly indicated, all numerical quantities in this description indicating amounts of material or conditions of reaction andlor use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymere", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not necessarily preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types. and numbers of atoms present in it, irrespective of whether the species is ionic, unstable, hypothetical, or in fact a stable electrically neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

SUMMARY OF THE INVENTION

It has been found that at least one object, and in preferred embodiments two or more objects, of the invention as stated above can be achieved by a two step process in which the first step is exposure of the anodized surface to be sealed to an aqueous solution containing lithium cations and fluoride anions at a relatively low temperature, followed by a short treatment with a different treatment composition at a higher temperature than the second step. The pH and silicon content of the aqueous solution used for the first treatment step are carefully controlled to achieve consistently satisfactory results. Compositions for use according to process embodiments of the invention, concentrate compositions from which such compositions for use can be made by mixing and dilution with water, and articles of manufacture treated by a process according to the invention are also within the scope of the invention.

DETAILED DESCRIPTION OF THE INVENTION

Preferred compositions for use in a first step of sealing according to the invention comprise, preferably consist essentially of, or more preferably consist of, water and:

(A) a concentration of dissolved lithium cations; and (B) a concentration of dissolved fluoride ions; and, optionally, one or more of the following components:

(C) a component of one or more dissolved, dispersed, or both dissolved and dispersed surfactants;

(D) a component of dissolved pH controlling agent that is not part of any of components (A), (B), and (C);

(E) a component of preservative material that is not part of any of components (A), (B), (C), and (D);

(F) not more than 5.0 parts of silicon per million parts by weight of the total composition, a concentration unit which may be applied to other constituents as well as silicon and is hereinafter usually abbreviated as "ppm", in any dissolved or suspended chemical form;

(G) up to 2000 ppm of complex transition metal containing anions, said anions not being part of any of components (A) through (F) as recited above and being selected from the group consisting of simple and condensed molybdates, tungstates, and vanadates; and (H) up to 1000 ppm of polymers that are not part of any of components (A) through (G), said polymers being selected from the group consisting of homo- and co-polymers of at least one of acrylic acid, methacrylic acid, and maleic acid, all optionally bearing phosphonic acid substituents.

Component (A) may be derived from any sufficiently water soluble lithium salt, including the fluoride, which would also supply component (B). However, the preferred concentrations of components (A) and (B) are such that if lithium fluoride, with a water solubility of only about 1 part per thousand by weight, is used as the source of component (A), only slight dilution of a saturated solution is possible without reducing the concentration of at least one of components (A) and (B) below the most preferred level. Furthermore, if the solid salt is used as a source of components (A) and (B), it may be slow to dissolve, and the relatively small amounts of it needed may be difficult to measure and control accurately enough at the point of use. Still further, the most preferred ratio between fluoride and lithium concentrations is lower than that in lithium fluoride salt. For all of these reasons, the normally preferred source of component (A) is lithium acetate, which is relatively inexpensive and very soluble in water, so that concentrates can easily be prepared, and/or lithium hydroxide, which is also relatively inexpensive and sufficiently soluble in water to make useful concentrates, even though it is much less soluble than lithium acetate.

A concentrate composition according to the invention preferably contains at least, with increasing preference in the order given, 2, 4, 6, 8, or 10 times the concentration of at least one of the ingredients, other than water, that is specified as preferred for one of the necessary components of a working sealing composition to be used in a first sealing step in a process according to the invention. Thus at least two concentrates of preferred strength are needed for making a preferred working sealing composition to be used in a first sealing step in a process according to this invention. Preferably one of them contains lithium acetate and, optionally, additional acetic acid, while another contains the principal fluoride source. Each preferably also contains any surfactant desired in the working composition to be made from the two concentrates, so that each may be used as a replenisher for a volume of working composition to be operated for a long time, without depleting the content of surfactant by drag-out of the sealing composition on surfaces treated with it.

Irrespective of its source, the concentration of lithium cations in a liquid composition used in a first sealing step according to the invention preferably is at least, with increasing preference in the order given, 0.05, 0.07, 0.09, 0.11, 0.13, 0.15, 0.17, 0.19, 0.21, 0.23, or 0.25 grams of lithium cations per liter of solution, a unit which may be applied to any other material as well as to lithium and is hereinafter usually abbreviated as "g/l", and independently, primarily for reasons of economy, preferably is not more than, with increasing preference in the order given, 3.0, 2.0, 1.0, 0.80, 0.70, 0.60, 0.50, 0.45, 0.40, 0.37, or 0.35 g/l.

Any sufficiently water soluble fluoride salt and/or hydrofluoric acid may be used as the source of component (B). It has been found that the presence of relatively small amounts of silicon, in any chemical form found in many commercially sourced fluoride salts that have not been particularly carefully kept free of silicon, in a composition used in a first sealing step according to this invention can be highly detrimental to the corrosion resistance of the resulting sealed coating, so that one aspect of the preferred source of component (B) is a low silicon content. Sodium and potassium fluorides have both been found satisfactory and are generally preferred, any preference between them, or indeed among any of the many possible sources of fluoride, being largely a matter of minimizing the cost of sources sufficiently free from silicon content. The fluoride also may be supplied in complexed form, for example as fluorozirconate, fluorotitanate, or fluoroborate, or as acid fluorides, but normally these sources are more expensive and are less preferred at least for that reason.

Irrespective of its source, the concentration of component (B) in a liquid composition used for a first sealing step according to this invention preferably is at least, with increasing preference in the order given, 0.08, 0.12, 0.16, 0.20, 0.24, 0.28, 0.32, 0.36, 0.39, 0.41, 0.43, or 0.45 g/l and independently, primarily for reasons of economy, preferably is not more than, with increasing preference in the order given, 6.0, 4.0, 2.0, 1.5, 1.3, 1.1, 0.90, 0.80, 0.70, 0.65, or 0.62 g/l.

Irrespective of the actual concentrations of fluoride anions and lithium cations in a composition to be used in a first sealing step according to this invention, the ratio of the mass of fluoride anions to the mass of lithium cations preferably is at least, with increasing preference in the order given, 0.50:1.0, 0.60:1.0, 0.70:1.0, 0.80:1.0, 0.90:1.0, 1.00:1.0, 1.10:1.0, 1.20:1.0, 1.30:1.0, or 1.35:1.0 and independently preferably is not more than, with increasing preference in the order given, 6.0:1.0, 5.0:1.0, 4.0:1.0, 3.7:1.0, 3.4:1.0, 3.1:1.0, 2.8:1.0, 2.6:1.0, or 2.4:1.0.

The presence of surfactant in a composition to be used in a first sealing step in a process according to this invention is ordinarily preferred. Without limiting the invention by any theory, it is hypothesized that a surfactant is useful in aiding the penetration of the liquid composition into very small pores in the anodized coating. Any surfactant may be used, nonionic surfactants are preferred, and ethoxylates of fatty amines are particularly preferred as surfactants. The concentration of surfactant in a composition to be used in a first sealing step in a process according to this invention preferably is at least, with increasing preference in the order given, 0.1, 0.3, 0.5, 0.7, 0.80, 0.90, 1.00, or 1.10 milligrams of surfactant per liter of composition, a unit which may be used for other concentrations as well as for surfactant and is hereinafter usually abbreviated as "mg/l", and independently preferably is not more than, with increasing preference in the order given, 100, 50, 25, 10, 8, 6, 4, 3.5, 3.0, 2.5, 2.0, 1.8, 1.6, or 1.4 mg/l.

The value of pH in a composition to be used in a first sealing step in a process according to this invention has been found to have a significant effect on the degree of corrosion protection achieved by a sealing treatment according to the invention. This pH value preferably is at least, with increasing preference in the order given, 6.7, 6.9, 7.1, or 7.3 and independently preferably is not more than, with increasing preference in the order given, 10.5, 10.2, 9.9, 9.6, 9.3, 9.0, 8.7, 8.4, 8.1, 7.9, or 7.7. Ordinarily when (i) the lithium and fluoride concentrations are within the most preferred ranges stated above, (ii) the lithium has been provided from an alkaline source such as hydroxide or acetate, and (iii) fluoride has been provided from a neutral salt, acidification will be required to bring the pH within a highly preferred range, and acetic acid is preferred for this purpose, particularly if a substantial fraction of the lithium cation content has been supplied by lithium acetate, so that the acetate and acetic acid contents can act as a buffer to retard pH changes. Any other buffer that does not harm the sealing effect could, of course, also be used.

As already briefly noted, silicon in some undetermined chemical form that occurs in many sources of fluoride ions can be highly detrimental to the quality of corrosion resistance achieved by a sealing process according to this invention. Accordingly, a liquid composition to be used in a first sealing step in a process according to this invention preferably contains not more than, with increasing preference in the order given, 4.5, 4.0, 3.5, 3.0, 2.5, 2.0, 1.5, 1.0, 0.80, 0.70, 0.65, or 0.60 ppm of silicon.

During use of a sealing composition in a first sealing step process according to this invention, the temperature of the sealing composition preferably is at least, with increasing preference in the order given, 10, 12, 14, 16, 18, or 20° C. and independently, primarily for reasons of economy, preferably is not more than, with increasing preference in the order given, 75, 60, 50, 40, 35, 33, 31, 29, or 27 0C. The time of contact between an anodized substrate being treated and a liquid composition being used in a first sealing step in a process according to this invention preferably is at least, with increasing preference in the order given, 1.0, 2.0, 3.0, 4.0, 5.0, 6.0, 7.0, 8.0, or 9.0 minutes, hereinafter usually abbreviated as "min", and independently, primarily for reasons of economy, preferably is not more than, with increasing preference in the order given, 30, 25, 20, 18, 16, 14, 12, or 10 min.

After treatment in a first sealing step according to this invention, the surface of an anodized substrate preferably is rinsed with water, more preferably deionized or other equally well-purified water, for a time of at least, with increasing preference in the order given, 0.1, 0.3, 0.5, 0.7, 0.90, or 0.98 min and then transferred, without being allowed to dry, to contact with the second sealing step in a process according to this invention. The liquid sealing composition to be used in a second sealing step in a process may consist of pure water only, and may contain any other constituents known in the art to be useful in hot sealing compositions for anodized aluminum. Preferably, a liquid composition to be used in a second sealing step in a process according to this invention contains, in addition to water, at least 0.2 parts of a neutral buffer, such as ammonium acetate, per thousand parts of total composition, hereinafter usually abbreviated as "ppt", a concentration unit that may be applied hereinafter to other materials as well as to the neutral buffer, and at least 0.03 ppt of cyclic polycarboxylic acids, diphosphonic acids, and/or their salts as a smut inhibitor. Most preferably, the pentasodium salt of cyclohexanehexacarboxylic acid is used for the latter purpose.

It has been found that if, in addition to such ingredients known from the prior art, a liquid composition to be used in a second sealing step in a process according to this invention contains lithium, nickel, and/or cobalt cations, the required temperature for effective sealing can be lowered substantially. If adequate pollution abatement to satisfy local requirements is inexpensively available, such additions may lower overall costs and therefore be advantageous. The presence of 100 ppm of nickel or cobalt in a liquid composition to be used in a second sealing step in a process according to this invention permits adequate sealing to be achieved in 10 minutes at 82° C., while an otherwise identical composition without any cations other than ammonium and sodium requires a temperature of 93° C. to achieve equally good protection in the same time from the second sealing step. Lithium additions are less effective than nickel or cobalt but still permit lowering the second step sealing temperature to 88° C. under the same conditions. Where pollution requirements are very strict, however, any composition used in a process according to this invention preferably contains not more than, with increasing preference in the order given, 1000, 750, 500, 300, 200, or 110 ppm of a total of cobalt, nickel, or other heavy metals.

Practice of and benefits of this invention may be further appreciated from consideration of the working and comparison examples described below.

GENERAL PROCESSING PROCEDURE

The following process steps were performed in the order shown on all substrates before any sealing treatment, unless specifically indicated to the contrary below:

1. Cleaning by immersion for 5 min in a solution in water of 22–30 g/l of RIDO-LINE® 18 cleaner concentrate at 60° C.
2. Rinse for 1 min with tap water.
3. Etch by exposure for 10 min to a solution in water of 6.5–7.5% of free NaOH, 25–45 g/l of dissolved aluminum, and 1.2 milliliters of P3® ALMECO 46 concentrate per liter of solution, the solution being maintained at 57° C.
4. Rinse twice, for 1 min each time, with tap water.
5. Desmut by exposure for 2 min at normal ambient human comfort temperature (20–27° C.) to a solution in water of about 7% by volume of DEOXALUME® D90 concentrate, to provide 6 to 8 titration points, and of sulfuric acid, to provide 20–25 titration points.
6. Rinse twice, for 1 min each time, with tap water.
7. Anodize at a current density of 1.6 amperes per square decimeter in a solution 5 in water of 165 to 185 g9l of sulfuric acid and 4–8 g/l of dissolved aluminum, maintained within a temperature range from 20 to 22° C., for about 35 min to produce an anodized layer with a thickness of 18 to 20 micrometers, these anodization conditions being preferred for preceding a process of sealing according to this invention.
8. Rinse for 1 min with tap water, RIDOLINED 18 cleaner concentrate, P3® ALMECO 46 concentrate, and DEOXALUME® D90 concentrate are all commercially available from the Henkel Surface Technologies Div. of Henkel Corp. (hereinafter usually abbreviated as "HST"), Madison Heights, Mich., and directions for determining the titration points noted in step 5 above are available from the same source in connection with the purchase of DEOXALUME® D90 concentrate.

After step 8, substrates were subjected to the various sealing conditions noted below, without being allowed to dry, except that some of them were given a bronze color by electrolysis for 2 min, with conventional sinusoidal alternating current at a total root mean square potential difference of 16 volts between the sample and a counter electrode, in an electrolyte containing 10 percent by volume in water of P3® ALMECOLOR ST2 M/U concentrate, commercially available from HST, and then rinsed for 1 min with tap water. When this step was used, substrates also were subjected to the beginning of sealing treatment before being allowed to dry after the post-coloring water rinse.

After sealing and drying, the corrosion protective value of the seal coat formed was usually evaluated by an Acid Dissolution Test (hereinafter usually abbreviated as "ADT") according to American Society for Testing and Materials Procedure 680, which is the same as International Standards Organization Procedure 3210. If the loss is ≦40.0 milligrams per square decimeter of surface, the test is passed. Lower values are more preferable. Substrates that had been subjected to both first and second steps of sealing were tested immediately after completion of sealing, while those for which the second step was omitted were tested 24 hours after completion of the first step, unless otherwise noted.

EXAMPLE

And

Comparison Example Group 1

Sealing conditions and ADT results for this group are shown in Table 1 below.

TABLE 1

| | First, Low Temperature, Sealing Step | | | | | Second or Only Sealing Step | | | |
|---|---|---|---|---|---|---|---|---|---|
| | Composition Characteristics | | | | | | | | ADT, |
| No. | Cat-ions | $F^-$ Source | Max. Si, ppm | Time, Min | Temp., ° C. | Spec. Cat. | Time, Min | Temp, ° C. | mg/dm$^2$ |
| 1c | | No low temperature step used | | | | — | 10 | 96.1 | 101 |
| 2c | | No low temperature step used | | | | — | 30 | 96.1 | 42 |
| 3c | Ni | KF | n.k. | 5 | 23 | — | 10 | 96.1 | 38 |
| 4c | Li | NaF | 5[m] | 10 | 23 | — | 10 | 96.1 | 305 |
| 5c | Li | NaF | 5[m] | 10 | 23 | — | 10 | 96.1 | 260 |
| 6c | Ni | KF | n.k. | 10 | 23 | — | 10 | 96.1 | 27 |
| 7c | Li | NaF | 3 | 15 | 27 | — | 10 | 96.1 | 226 |
| 8c | Li | NaF | 3 | 15 | 27 | — | 20 | 96.1 | 49 |
| 9 | Li | NaF | 0.16 | 10 | 27 | — | 10 | 96.1 | 20.8 |
| 10 | Li | NaF | 0.16 | 15 | 27 | — | 10 | 96.1 | 21.1 |
| 11c | Ni | KF | n.k. | 5 | 27 | — | 10 | 96.1 | 3.4 |
| 12c | Ni | KF | n.k. | 5 | 27 | — | 10 | 96.1 | 17.9 |
| 13c | Li | NaF | 0.16 | 10 | 27 | No second step used | | | 146 |
| 14 | Li | NaF | 0.16 | 10 | 27 | — | 10 | 96.1 | 25.0 |
| 15 | Li | KF | 0.59 | 10 | 21 | — | 10 | 96.1 | 12.1 |
| 16 | Li | KF | 0.59 | 10 | 27 | | 10 | 96.1 | 15.8 |
| 17c | Ni | KF | n.k. | 5 | 27 | — | 10 | 96.1 | 19.2 |
| 18c | Li | KF | 0.59 | 10 | 27 | No second step used | | | 139 |
| 19 | Li | KF | 0.59 | 10 | 27 | — | 10 | 87.8 | 184 |
| 20c | Ni | KF | n.k. | 10 | 27 | — | 10 | 87.8 | 90.5 |
| 21 | Li | KF | 0.59 | 10 | 27 | — | 10 | 87.8 | 117 |
| 22 | Li | KF | 0.59 | 5 | 27 | — | 10 | 96.1 | 92.2 |
| 23c | Li | KF | 0.59 | 10 | 27 | No second step used | | | 228 |
| 24c | Li | KF | 0.59 | 15 | 27 | No second step used | | | 115 |
| 25c | Ni | KF | n.k. | 10 | 23 | — | 10 | 96.1 | 27.2 |
| 26 | Li | KF | 0.59 | 10 | 23 | — | 10 | 96.1 | 15.1 |
| 27 | Li | NaF | 0.16 | 10 | 23 | — | 10 | 96.1 | 13.0 |
| 28 | Li | KF | 0.59 | 5 | 23 | — | 10 | 96.1 | 14.0 |
| 29 | Li | KF | 0.59 | 5 | 23 | — | 10 | 96.1 | 19.5 |
| 30 | Li | KF | 0.59 | 5 | 23 | Co | 10 | 82.2 | 202 |
| 31 | Li | KF | 0.59 | 5 | 23 | Ni | 10 | 82.2 | 164 |
| 32 | Li | KF | 0.59 | 10 | 23 | Co | 10 | 87.8 | 44.8 |
| 33 | Li | KF | 0.59 | 10 | 23 | Ni | 10 | 87.8 | 35.6 |
| 34 | Li | KF | 0.59 | 10 | 23 | Co | 10 | 87.8 | 26.8 |
| 35 | Li | KF | 0.59 | 10 | 23 | Ni | 10 | 87.8 | 26.8 |
| 36 | Li | KF | 0.59 | 10 | 23 | Co | 10 | 82.2 | 22.0 |
| 37 | Li | KF | 0.59 | 10 | 23 | Ni | 10 | 82.2 | 22.6 |
| 38 | Li | KF | 0.59 | 10 | 23 | — | 10 | 96.1 | 18.6 |
| 39 | Ni | KF | n.k. | 5 | 23 | Co | 10 | 82.2 | 8.8 |
| 40 | Ni | KF | n.k. | 5 | 23 | Ni | 10 | 82.2 | 5.4 |
| 41 | Li | KF | 0.59 | 10 | 23 | Li | 10 | 82.2 | 101 |
| 42b | Ni | KF | n.k. | 10 | 23 | Co | 10 | 82.2 | 84.8 |
| 43b | Ni | KF | n.k. | 10 | 23 | Ni | 10 | 82.2 | 28.8 |
| 44b | Li | KF | 0.59 | 5 | 23 | Li | 10 | 87.8 | 117 |
| 45b | Li | KF | 0.59 | 10 | 23 | Li | 10 | 87.8 | 37.4 |
| 46 | Li | KF | 0.59 | 10 | 23 | Li | 10 | 87.8 | 19.0 |
| 47 | Ni | KF | n.k. | 10 | 23 | Co | 10 | 82.2 | 4.8 |
| 48[Co] | Li | KF | 0.59 | 5 | 23 | — | 10 | 82.2 | 148 |
| 49[Co] | Li | KF | 0.59 | 5 | 23 | — | 10 | 82.2 | 124 |
| 50 | Li | KF | 0.59 | 10 | 23 | Li | 10 | 87.8 | 20.6 |
| 51[Ni] | Li | KF | 0.59 | 5 | 23 | — | 10 | 82.2 | 180 |
| 52[Ni] | Li | KF | 0.59 | 10 | 23 | — | 10 | 82.2 | 43.9 |

TABLE 1-continued

| | First, Low Temperature, Sealing Step | | | | | Second or | | | |
|---|---|---|---|---|---|---|---|---|---|
| | Composition Characteristics | | | | | Only Sealing Step | | | ADT, |
| No. | Cat-ions | $F^-$ Source | Max. Si, ppm | Time, Min | Temp., ° C. | Spec. Cat. | Time, Min | Temp, ° C. | mg/dm$^2$ |
| 53b$^{Ni}$ | Li | KF | 0.59 | 5 | 23 | — | 10 | 82.2 | 265 |
| 54b$^{Ni}$ | Li | KF | 0.59 | 10 | 23 | — | 10 | 82.2 | 70.5 |

Abbreviations and Other Notes for Table 1

"No." "Number". A "c" as part of the number indicates that this item is a comparison, not according to the invention. A "b" as part of the number means that the substrate for this item was colored bronze before sealing; for all other numbers, no coloring of the substrate occurred before sealing. A superscript atomic symbol "Co" or "Ni" as part of the number means that the liquid composition for the first sealing step contained 100 ppm of cations of the element indicated, in addition to its other noted constituents.

"Max." means "Maximum Concentration of". If the number in a cell of the table under the heading "Max. Si, ppm" has a superscript "m", the value was determined by analysis of a concentrate used to make the composition in question, and corrected to correspond to the dilution factor of the concentrate in the concentration as actually used. Otherwise, this number was calculated from the upper limit, as specified by the supplier of the fluoride source used, for any siliceous material (usually the fluorosilicate salt corresponding to the fluoride major constituent), stoichiometrically converted to elemental silicon and calculated for the concentration of the major fluoride source in the composition in question. The other materials used are believed to be free from any amount of silicon sufficient to change the values calculated in this manner, but no specific testing to verify this belief was performed.

"Temp." means "Temperature": "n.k." means "not known".

"Spec. Cat." means "Special Cations"; elements with atomic symbols in a cell under this heading were present as cations at a concentration of 100 ppm in the liquid composition used in the second sealing step for the row of the table where the entry appears; these cations were added as their acetate salts. If a hyphen appears as the only entry in a cell under this heading, no special cations were added.

EXAMPLE GROUP 2

In this group, only first sealing step conditions were varied; the second sealing step in all instances was exposure for 10 min at 96° C. to a solution in water of 2 g/l of HST P3® ALMECO SL concentrate, with a pH value in the range from 5.6 to 6.0. In addition to the ingredients explicitly shown in Table 2, all first sealing compositions contained acetate counterions for the lithium cations, potassium counterions for the fluoride anions, additional acetic acid and, if needed, potassium hydroxide, to adjust the pH values, and 1–2 mg/l of CHEMEEN™ C-12G surfactant, a product obtained commercially from Chemax, Inc. and reported by its supplier to be ethoxylates of primary amines with the alkyl groups derived from natural coconut oil. First step sealing conditions and ADT results for this group are shown in Table 2 below.

TABLE 2

| | Seal Time, | First Sealing Composition Characteristics: | | | |
|---|---|---|---|---|---|
| No. | Min. | $Li^+$, g/l | $F^-$, g/l | pH | ADT mg/dm$^2$ |
| 1 | 5.0 | 0.26 | 0.61 | 9.0 | 17 |
| 2 | 5.0 | 0.30 | 0.48 | 5.0 | 331 |
| 3 | 5.0 | 0.26 | 0.61 | 9.0 | 15.4 |
| 4 | 5.0 | 0.32 | 0.58 | 8.0 | 18.1 |
| 5 | 5.0 | 0.28 | 3.75 | 8.0 | 21.4 |
| 6 | 5.0 | 0.30 | 0.54 | 7.0 | 23.7 |
| 7 | 5.0 | 0.34 | 0.61 | 5.0 | 335 |
| 8 | 5.0 | 0.28 | 0.58 | 8.0 | 18 |
| 9 | 5.0 | 0.30 | 0.54 | 7.0 | 23 |
| 10 | 5.0 | 0.34 | 0.48 | 9.0 | 13 |
| 11 | 5.0 | 0.34 | 0.48 | 9.0 | 14.9 |
| 12 | 5.0 | 0.30 | 0.54 | 5.5 | 270 |
| 13 | 5.0 | 0.30 | 0.54 | 6.0 | 150 |
| 14 | 5.0 | 0.30 | 0.54 | 6.5 | 40.3 |

TABLE 2-continued

| | Seal Time, | First Sealing Composition Characteristics: | | | |
|---|---|---|---|---|---|
| No. | Min. | $Li^+$, g/l | $F^-$, g/l | pH | ADT mg/dm$^2$ |
| 15 | 5.0 | 0.30 | 0.54 | 7.0 | 37.2 |
| 16 | 5.0 | 0.30 | 0.54 | 7.5 | 19.9 |
| 17 | 5.0 | 0.28 | 0.58 | 8.0 | 20.8 |
| 18 | 5.0 | 0.34 | 0.48 | 9.0 | 26.1 |
| 19 | 5.0 | 0.26 | 0.61 | 8.8 | 20.2 |
| 20 | 10 | 0.30 | 0.54 | 6.5 | 23 |
| 21 | 10 | 0.30 | 0.54 | 7.0 | 10.6 |
| 22 | 10 | 0.30 | 0.54 | 7.5 | 7.8 |
| 23 | 10 | 0.28 | 0.58 | 8.0 | 9 |
| 24 | 10 | 0.34 | 0.48 | 9.0 | 9.4 |
| 25 | 10 | 0.26 | 0.61 | 7.5 | 9.7 |
| 26 | 10 | 0.26 | 0.61 | 7.0 | 8.9 |

EXAMPLE 3

Six liters of initial composition containing 0.30 g/l of lithium cations, from lithium hydroxide reacted with acetic acid, 0.54 g/l of fluoride, from potassium fluoride containing not more than 0.25 % of potassium fluorosilicate, and 1.3 mg/l of CHEMEEN™ C-12G surfactant, a product obtained commercially from Chemax, Inc. and reported by its supplier to be ethoxylates of primary amines with the alkyl groups derived from natural coconut oil, and additional acetic acid as needed to bring the pH value to 7.5, with the balance water, were prepared and used for a reagent consumption study. Substrate anodized aluminum panels aggregating to 532 square decimeters of surface were passed through the bath. Additional active ingredients were added to the initially prepared bath as needed to maintain approximately constant concentrations of lithium and fluoride, the total additions aggregating to about 1.5 times the total content of these ingredients in the initial bath. Consumption was calculated to be 1.38 grams of lithium acetate and 0.40 grams of potassium fluoride per square meter of anodized surface processed. The flat shape of the surfaces processed is believed to have minimized drag-out loss, so that these numbers are probably close to lower limits of consumption that could be expected in practical operations.

At intervals during this process, some of the treated panels were subjected to a second process step according to the invention by exposure for 10 min at 96° C. to a solution in water of 2 g/l of HST P3® ALMECO SL concentrate, with a pH value in the range from 5.6 to 6.0. All such panels passed the ADT test already described above, thereby indicating the continued effectiveness of the first sealing composition.

What is claimed is:

1. A process for sealing an anodized aluminum surface, said process comprising operations of:

(I) bringing the anodized aluminum surface into contact for not more than 30 minutes at a temperature not greater than 75° C. with a liquid first sealing composition having a pH value of at least 6.7 and comprising water and:

(A) a concentration of lithium cations; and (B) a concentration of fluoride anions, said first sealing composition not comprising more than about 5.0 ppm of dispersed or dissolved silicon atoms; and (II) after completion of operation (I), bringing the anodized aluminum surface as modified by operation (I) into contact at a temperature of at least 82° C. with a second sealing composition comprising steam or liquid water.

2. A process according to claim 1, further comprising an operation of rinsing the anodized aluminum surface as modified by operation (I) with water for a period of time that is at least 0.1 minute to form a rinsed modified anodized aluminum surface, said rinsed modified anodized aluminum surface not being allowed to dry between operations (I) and (II).

3. A process according to claim 1, wherein:

the second sealing composition further comprises:

heavy metal cations in a concentration of up to 1000 ppm, said heavy metal cations being selected from the group consisting of nickel cations, cobalt cations, lithium cations, and combinations of one or more of nickel cations, cobalt cations, and lithium cations;

at least 0.2 ppt of a neutral buffer; and at least 0.03 ppt of a smut inhibitor selected from the group consisting of cyclic polycarboxylic acids, diphosphonic acids, salts of cyclic polycarboxylic acids, salts of diphosphonic acids, and combinations of one or more of cyclic polycarboxylic acids, diphosphonic acids, salts of cyclic polycarboxylic acids, and salts of diphosphonic acids; and the temperature during operation (11) is not more than about 88° C.

4. A process according to claim 1, wherein:

the first sealing composition has a pH value in a range from about 6.9 to about 9.0, inclusive of 6.9 and 9.0, and comprises:

(A) a concentration of at least about 0.09 g/l of lithium cations;

(B) a concentration of at least about 0.16 g/l of fluoride anions; and (C) a concentration of at least about 0.3 mg/l of surfactant molecules; and the concentration, measured in g/l, of fluoride anions in the first sealing composition has a ratio to the concentration, measured in g/l, of lithium cations in the first sealing composition that is at least about 0.9:1.0 and is not greater than about 3.4:1.0.

5. A process according to claim 4, further comprising an operation of rinsing the anodized aluminum surface as modified by operation (I) with water for a period of time that is at least 0.5 minute before conducting operation (II), so as to form a rinsed modified anodized aluminum surface, said rinsed modified anodized aluminum surface not being allowed to dry between operations (I) and (II).

6. A process according to claim 5, wherein the second sealing composition is a liquid and further comprises:

0.2 ppt or more of a neutral buffer;

0.03 ppt or more of a smut inhibitor; or both 0.2 ppt or more of a neutral buffer and 0.03 ppt or more of a smut inhibitor.

7. A process according to claim 6, wherein:

the second sealing composition further comprises heavy metal cations in a concentration up to about 1000 ppm, said heavy metal cations being selected from the group consisting of nickel cations, cobalt cations, lithium cations, and combinations of one or more of nickel cations, cobalt cations, and lithium cations;

the smut inhibitor is selected from the group consisting of cyclic polycarboxylic acids, diphosphonic acids, salts of cyclic polycarboxylic acids, salts of diphosphonic acids, and combinations of one or more of cyclic polycarboxylic acids, diphosphonic acids, salts of cyclic polycarboxylic acids, and salts of diphosphonic acids; and the temperature during operation (II) is not more than about 88° C.

8. A process according to claim 7, wherein:

the second sealing composition comprises at least about 100 ppm of heavy metal cations selected from the group consisting of nickel cations, cobalt cations, and mixtures of nickel and cobalt cations; and operation (II) is completed within a time that is not greater than about 10 minutes.

9. A process according to claim 8, wherein:

in operation (I):

the pH value of the first liquid sealing composition is within a range from 7.5 to 8.0, inclusive of 7.5 and 8.0;

the temperature of the first liquid sealing composition is within a range from about 20 to about 27° C., inclusive of 20 and 27° C.; and the time of contact of the anodized aluminum surface with the first liquid sealing composition is within a range from 9 to 10 minutes, inclusive of 9 and 10 minutes;

said first liquid sealing composition comprises:

from about 1.1 to about 1.4 mg/l of surfactant molecules;

from about 0.45 to about 0.62 g/l of fluoride anions; and from about 0.25 to about 0.35 g/l of lithium cations; and in said first liquid sealing composition, the concentration in g/l of the fluoride anions has a ratio to the concentration in g/l of the lithium cations that is from about 1.35:1.0 to about 2.40:1.0.

10. A process for sealing an anodized aluminum surface, said process comprising operations of:

(I) bringing the anodized aluminum surface into contact for not more than 30 minutes at a temperature not greater than 75° C. with a liquid first sealing composition that has a pH value of at least 6.7 and has been made by mixing together a first mass of water and:

(A) a second mass of a water soluble source of lithium cations; and (B) a third mass of a water soluble source of fluoride anions, said first sealing composition not comprising more than about 5.0 ppm of dispersed or dissolved silicon atoms; and (II) after completion of operation (I), bringing the anodized aluminum surface as modified by operation (I) into contact at a temperature of at least 82° C. with a second sealing composition comprising steam or liquid water.

11. A process according to claim 10, further comprising an operation of rinsing the anodized aluminum surface as modified by operation (I) with water for a period of time that is at least 0.1 minute, so as to form a rinsed modified anodized aluminum surface, said rinsed modified anodized aluminum surface not being allowed to dry between operations (I) and (II).

12. The process according to claim 10, wherein:

there has additionally been mixed into said second sealing composition;

a fourth non-zero mass of a water soluble source of heavy metal cations that corresponds to a concentration of up to about 1000 ppm of said heavy metal cations in said second sealing composition, said heavy metal cations being selected from the group consisting of nickel cations, cobalt cations, lithium cations, and combinations of one or more of nickel cations, cobalt cations, and lithium cations;

a fifth mass of neutral buffer that corresponds to a concentration of at least 0.2 ppt of neutral buffer in said second sealing composition; and a sixth mass of smut inhibitor that corresponds to a concentration of at least 0.03 ppt of smut inhibitor in said second sealing composition, said smut inhibitor being selected from the group consisting of cyclic polycarboxylic acids, diphosphonic acids, and salts of cyclic polycarboxylic acids, salts of diphosphonic acids, and combinations of one or more of cyclic polycarboxylic aids, diphosphonic acids, and salts of cyclic polycarboxylic acids, and salts of diphosphonic acids; and the temperature during operation (II) is not more than about 88° C.

13. A process according to claim 10, wherein:

the first sealing composition has a pH value in a range from about 6.9 to about 9.0, inclusive of 6.9 and 9.0, and has been made by mixing with said first mass of water:

(A) a second mass in grams of a water soluble source of lithium cations that corresponds to a concentration of at least about 0.09 g/l of lithium cations in said first sealing composition;

(B) a third mass in grams of a water soluble source of fluoride anions that corresponds to a concentration of at least about 0.16 g/l of fluoride anions in said first sealing composition; and (C) a seventh mass in grams of surfactant molecules that corresponds to a concentration of at least about 0.3 mg/l of surfactant molecules in said first sealing composition; and said third mass in grams has a ratio to said second mass in grams that is at least about 0.9:1.0 and is not greater than about 3.4:1.0.

14. A process according to claim 13, further comprising an operation of rinsing the anodized aluminum surface as modified by operation (I) with water for a period of time that is at least 0.5 minute, so as to produce a rinsed modified anodized aluminum surface, said rinsed modified anodized aluminum surface not being allowed to dry between operations (I) and (II).

15. A process according to claim 14, wherein the second sealing composition is a liquid into which has been additionally mixed:

a fifth mass of a neutral buffer that corresponds to 0.2 ppt or more of said neutral buffer in said second sealing composition;

a sixth mass of a smut inhibitor that corresponds to 0.03 ppt or more of said smut inhibitor in said second sealing composition; or both said fifth mass of neutral buffer and said sixth mass of smut inhibitor.

16. A process according to claim 15, wherein:

there has been additionally mixed into said second sealing composition a fourth non-zero mass of heavy metal cations that corresponds to a concentration up to about 1000 ppm of said heavy metal cations in said second sealing composition, said heavy metal cations being selected from the group consisting of nickel cations, cobalt cations, lithium cations, and combinations of one or more of nickel cations, cobalt cations, and lithium cations;

the smut inhibitor is selected from the group consisting of cyclic polycarboxylic acids, diphosphonic acids, salts of cyclic polycarboxylic acids, salts of diphosphonic acids, and combinations of one or more of cyclic polycarboxylic acids, diphosphonic acids, salts of cyclic polycarboxylic acids, and salts of diphosphonic acids; and the temperature during operation (II) is not more than about 88° C.

17. The process according to claim 16, wherein;

the fourth mass of heavy metal cations corresponds to a concentration in said second sealing composition of at least about 100 ppm of heavy metal cations selected from the group consisting of nickel cations, cobalt cations, and mixtures of nickel and cobalt cations; and operation (II) is completed within a time that is not greater than about 10 minutes.

18. A process according to claim 17, wherein, in operation (I):

the pH value of the first liquid sealing composition is within a range from 7.5 to 8.0, inclusive of 7.5 and 8.0;

the temperature of the first liquid sealing composition is within a range from about 20 to about 27° C., inclusive of 20 and 27° C.; and the time of contact of the anodized aluminum surface with the first liquid sealing composition is within a range from 9 to 10 minutes, inclusive of 9 and 10 minutes;

the second mass of a water soluble source of lithium cations corresponds to a concentration that is from about 0.25 to about 0.35 g/l of lithium cations in the first sealing composition;

the third mass of a water soluble source of fluoride anions corresponds to a concentration of fluoride anions that is from about 0.45 to about 0.62 g/l of fluoride anions in the first liquid sealing composition;

the seventh mass of surfactant molecules corresponds to a concentration of from about 1.1 to about 1.4 mg/l of surfactant molecules in the first liquid sealing composition; and the third mass corresponds to a concentration in g/l of fluoride anions that has a ratio to the concentration in g/l of lithium cations to which the second mass corresponds that is from about 1.35:1.0 to about 2.40:1.0.

* * * * *

UNITED STATES PATENT AND TRADEMARK OFFICE

CERTIFICATE OF CORRECTION

PATENT NO. : 6,447,665 B1
DATED : September 10, 2002
INVENTOR(S) : Johnson et al.

It is certified that error appears in the above-identified patent and that said Letters Patent is hereby corrected as shown below:

Title page,
Item [57], ABSTRACT,
Line 6, after "considerably less time", insert therefor -- than --.

Column 13,
Line 34, delete "aids", and insert therefor -- acids --.

Signed and Sealed this

Thirty-first Day of August, 2004

JON W. DUDAS
*Director of the United States Patent and Trademark Office*